US010292564B2

(12) United States Patent
Swarnkar

(10) Patent No.: US 10,292,564 B2
(45) Date of Patent: May 21, 2019

(54) SPRAY ARM ASSEMBLIES FOR DISHWASHER APPLIANCES

(71) Applicant: General Electric Company, Schenectady, NY (US)

(72) Inventor: Rajesh Swarnkar, Bangalore (IN)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 696 days.

(21) Appl. No.: 14/943,094

(22) Filed: Nov. 17, 2015

(65) Prior Publication Data

US 2017/0135548 A1 May 18, 2017

(51) Int. Cl.

| | |
|---|---|
| ***A47L 15/20*** | (2006.01) |
| ***A47L 15/23*** | (2006.01) |
| ***A47L 15/42*** | (2006.01) |
| ***A47L 15/50*** | (2006.01) |
| ***B05B 1/20*** | (2006.01) |
| ***B05B 13/04*** | (2006.01) |

(52) U.S. Cl.

CPC ..... *A47L 15/20* (2013.01); *A47L 15/23* (2013.01); *A47L 15/4221* (2013.01); *A47L 15/4225* (2013.01); *A47L 15/50* (2013.01); *B05B 1/205* (2013.01); *B05B 13/0421* (2013.01)

(58) Field of Classification Search

CPC ..... A47L 15/20; A47L 15/23; A47L 15/4221; A47L 15/4225; A47L 15/50; B05B 1/205; B05B 13/0421

USPC ..... 134/56 D, 57 D, 58 D, 173

See application file for complete search history.

(56) References Cited

U.S. PATENT DOCUMENTS

| | | | | |
|---|---|---|---|---|
| 8,876,984 | B2 | 11/2014 | Hong et al. | |
| 2010/0043825 | A1* | 2/2010 | Bertsch | A47L 15/23 134/18 |
| 2013/0319487 | A1 | 12/2013 | Hong et al. | |

FOREIGN PATENT DOCUMENTS

| | | | |
|---|---|---|---|
| DE | 102010032006 | A1 | 1/2012 |
| DE | 102012104026 | A1 | 11/2013 |

OTHER PUBLICATIONS

Duden et al., "DE102012104026A1 English Machine Translation.pdf", Nov. 14, 2013—Machine translation from Espacenet.com.*

* cited by examiner

*Primary Examiner* — Levon J Shahinian

(74) *Attorney, Agent, or Firm* — Dority & Manning, P.A

(57) ABSTRACT

A spray arm system for cleaning articles in the wash chamber of a dishwasher appliance is provided. The spray arm system includes an elongated spray arm and an orbital spray arm positioned near opposite, bottom corners of the wash chamber. The elongated spray arm pivots about one corner within a horizontal plane and the orbital spray arm rotates about a central axis near the opposite corner. The elongated spray arm may be motor-driven, the orbital spray arm may be fluid-powered, and the spray arms may be operated independently or at the same time.

19 Claims, 10 Drawing Sheets

SPRAY ARM ASSEMBLIES FOR DISHWASHER APPLIANCES

FIELD OF THE INVENTION

The present disclosure relates generally to dishwasher appliances, and more particularly to improved spray arm assemblies for dishwasher appliances.

BACKGROUND OF THE INVENTION

Dishwasher appliances generally include a tub that defines a wash chamber. Rack assemblies can be mounted within the wash chamber of the tub for receipt of articles for washing. During wash and rinse cycles, spray assemblies within the wash chamber can apply or direct wash fluid (e.g. various combinations of water and detergent along with optional additives) towards articles disposed within the rack assemblies in order to clean such articles.

Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

One limitation of many currently known spray arm assemblies is the geometry of the spray arm assemblies relative to the geometry of the wash chamber. Most known spray arm assemblies utilize a generally circular geometry. For example, an arm of a spray arm assembly may rotate in a circle, and jets or apertures defined in the arm may emit wash fluid from the arm in this circular pattern. Each jet emits fluid in a constant direction from the associated arm during rotation, so that the locations reached by the wash fluid are predictable and limited. Further, the cross-sectional interior geometry of most currently known dishwasher appliance wash chambers is square or rectangular. Accordingly, the corners of such wash chambers, and the articles located therein, may not be sufficiently reached by wash fluid. These limitations can result in articles not being properly cleaned during operation of the dishwasher appliance.

Although certain known spray assemblies attempt to provide better spray coverage by increasing the number of spray arms or altering the spray action, these assemblies lack versatility in their manner of operation and are often inefficient in terms of energy and water usage. For example, these spray assemblies may only operate all spray arms simultaneously and/or at high flow rates, lack spray arms for dedicated zone cleaning, and have poor cleaning efficiency, thus requiring the use of excess water and energy.

Accordingly, improved spray arm assemblies and associated dishwasher appliances are desired in the art. In particular, improved spray arm assembly designs which increase the coverage of the wash fluid emitted therefrom would be advantageous. Spray arm assemblies that can also be operated in different modes, e.g., to operate multiple arms synchronously or asynchronously, would be particularly beneficial.

BRIEF DESCRIPTION OF THE INVENTION

The present subject matter provides a spray arm system for cleaning articles in the wash chamber of a dishwasher appliance. The spray arm system includes an elongated spray arm and an orbital spray arm positioned near opposite, bottom corners of the wash chamber. The elongated spray arm pivots about one corner within a horizontal plane and the orbital spray arm rotates about a central axis near the opposite corner. The elongated spray arm may be motor-driven, the orbital spray arm may be fluid-powered, and the spray arms may be operated independently or simultaneously. The resulting spray system provides improved spray coverage, versatility of operation, improved cleaning performance, and reduced water/energy usage compared to existing circular spray arms. Additional aspects and advantages of the invention will be set forth in part in the following description, may be apparent from the description, or may be learned through practice of the invention.

In accordance with one exemplary embodiment of the present disclosure, a spray arm system for cleaning articles in a wash chamber defined by a wash tub of a dishwasher appliance is provided. The wash tub has a bottom defining a first bottom corner and an opposing, second bottom corner. The spray arm system includes an elongated spray arm defining a plurality of orifices between a first end and a second end for directing wash fluid onto articles in the wash chamber. The spray arm is rotatably mounted at the first end to the first bottom corner so as to define a pivot point about which the spray arm is configured to swing back and forth within a first horizontal plane. The spray arm system also includes an orbital spray arm defining a plurality of orifices for directing wash fluid onto articles in the wash chamber. The orbital spray arm is positioned near the second bottom corner and is rotatable about a central axis of the orbital spray arm.

In accordance with another exemplary embodiment of the present disclosure, a dishwasher appliance is provided. The dishwasher appliance includes a wash tub that defines a wash chamber that defines lateral, transverse, and vertical directions. A rack assembly is slidably positioned within the wash chamber of the tub and configured for receipt of articles for washing. A spray arm system includes a first spray arm assembly including a drive motor, a gear box disposed at a first bottom corner of the wash chamber and operatively coupling the drive motor to an elongated spray arm. The elongated spray arm has a first end and a second end and configured to pivot about the first end between 0 degrees and 90 degrees in a first horizontal plane. The spray arm system also includes a second spray arm assembly including an orbital spray arm that is positioned near a second bottom corner and is rotatable about a central axis of the orbital spray arm. The orbital spray arm further defines at least two spray jets configured to spray in opposite directions to impart rotational force on the orbital spray arm about the central axis. A diverter selectively distributes wash fluid from a recirculating pump to the spray arm system.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
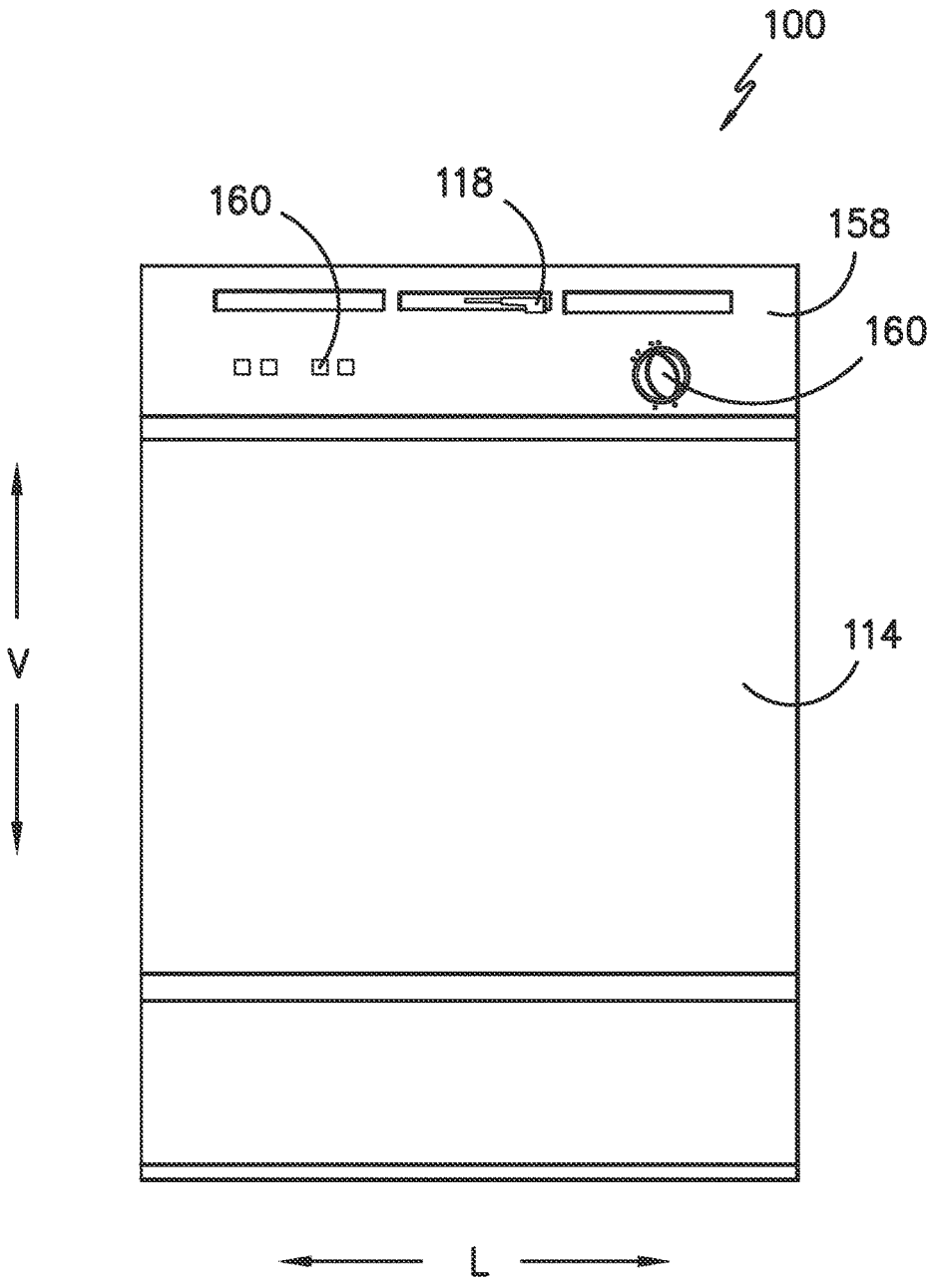
FIG. 1 provides a front view of an exemplary embodiment of a dishwashing appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "wash fluid" refers to a liquid used for washing and/or rinsing the articles and is typically made up of water that may include other additives such as detergent or other treatments.

Figure 2:
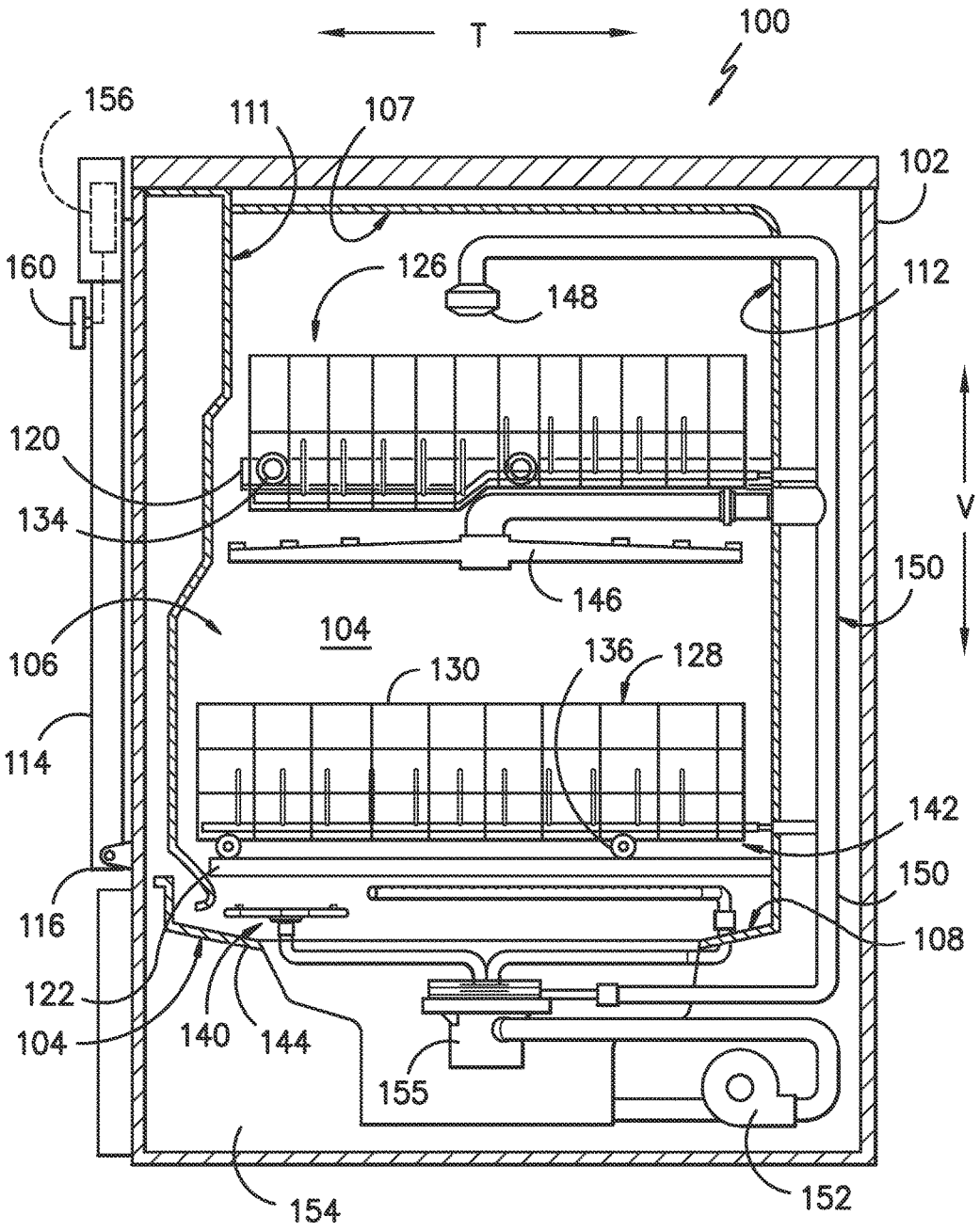
FIG. 2 provides a side cross sectional view of the exemplary dishwashing appliance of FIG. 1.
Figure 3:
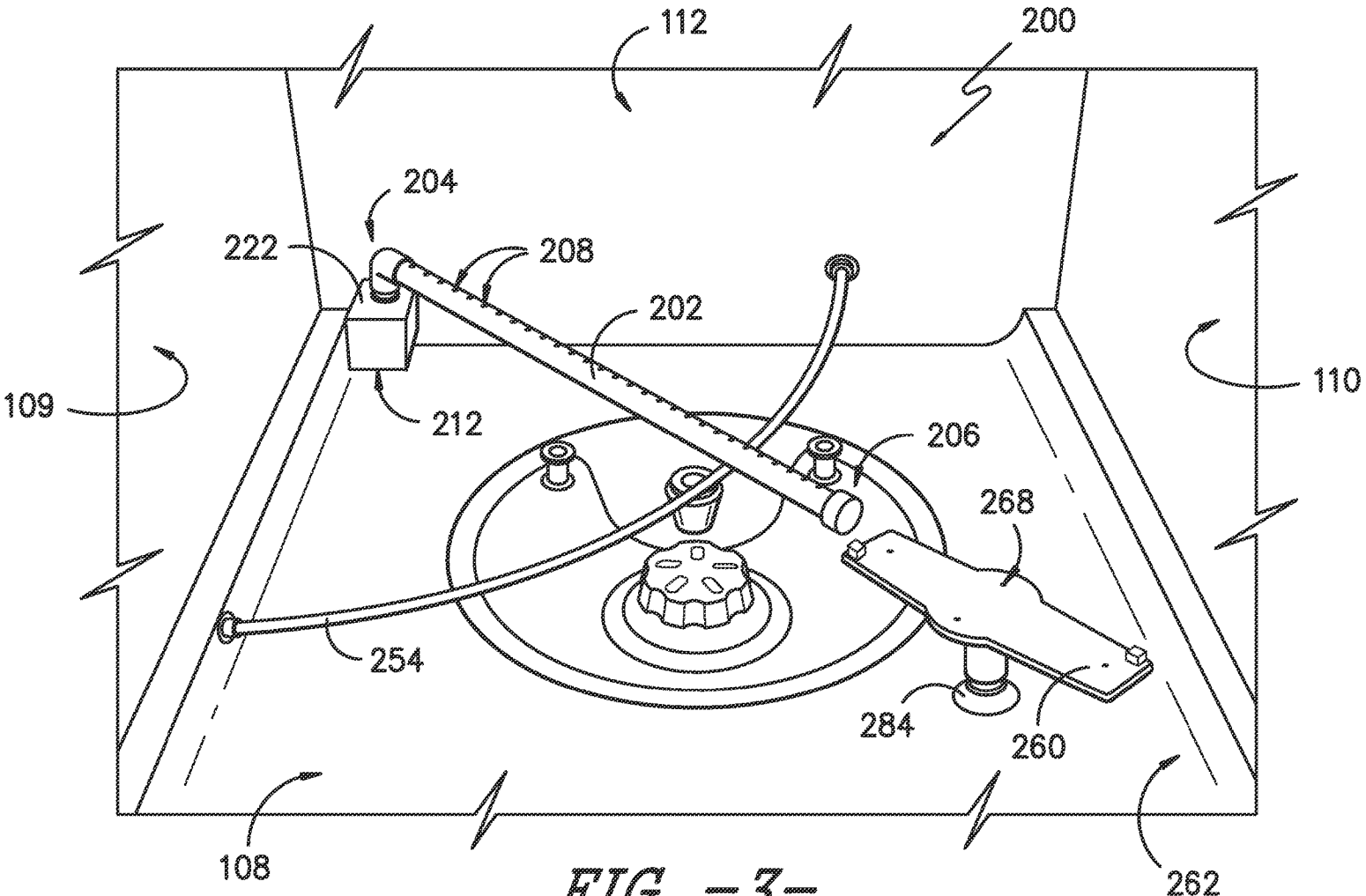
FIG. 3 is a front perspective view of a spray arm system according to an exemplary embodiment of the present disclosure.
Figure 4:
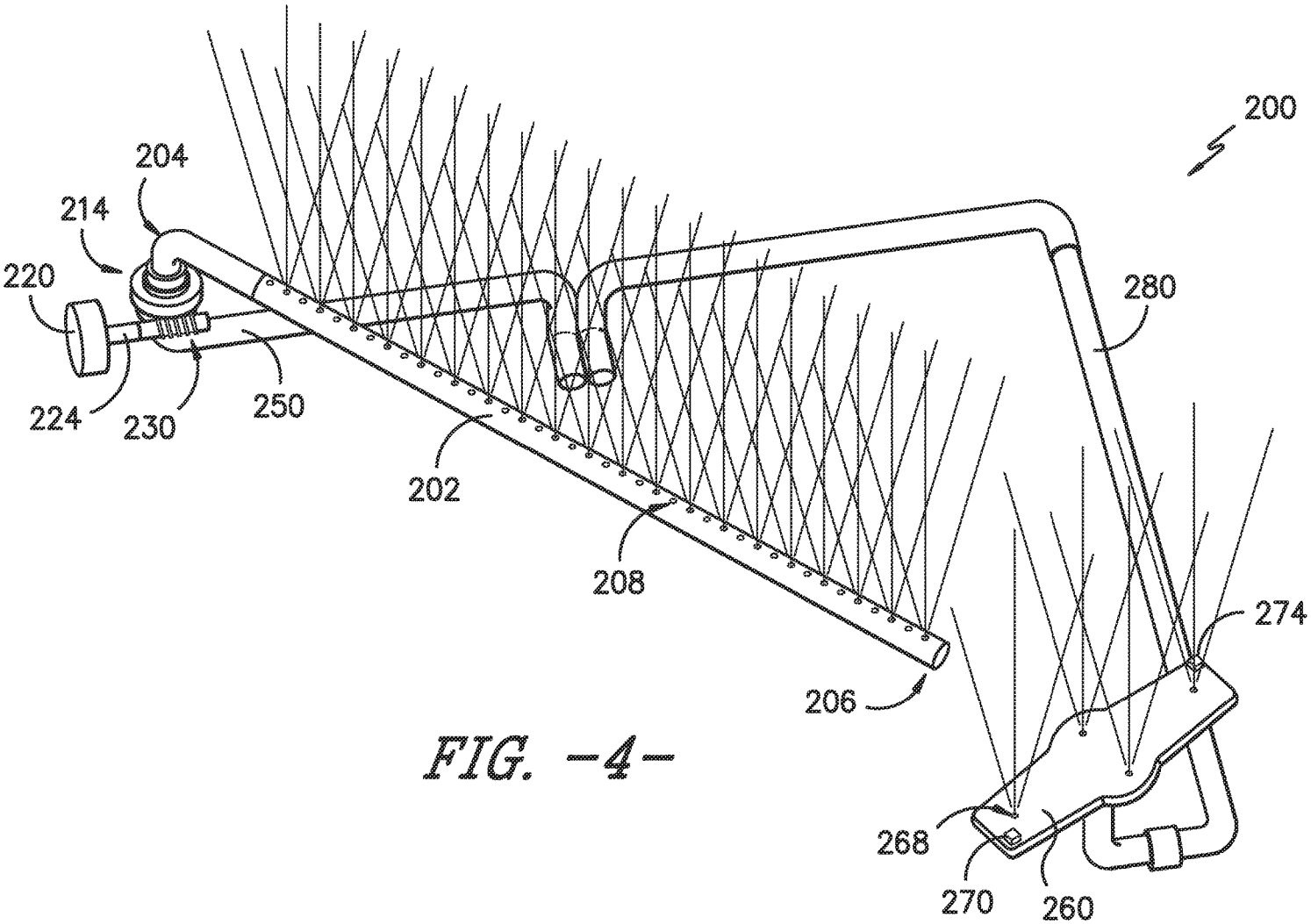
FIG. 4 is a front perspective view of the spray arm system of FIG. 3 with the remainder of the dishwasher appliance components hidden for illustrative purposes.
Figure 5:
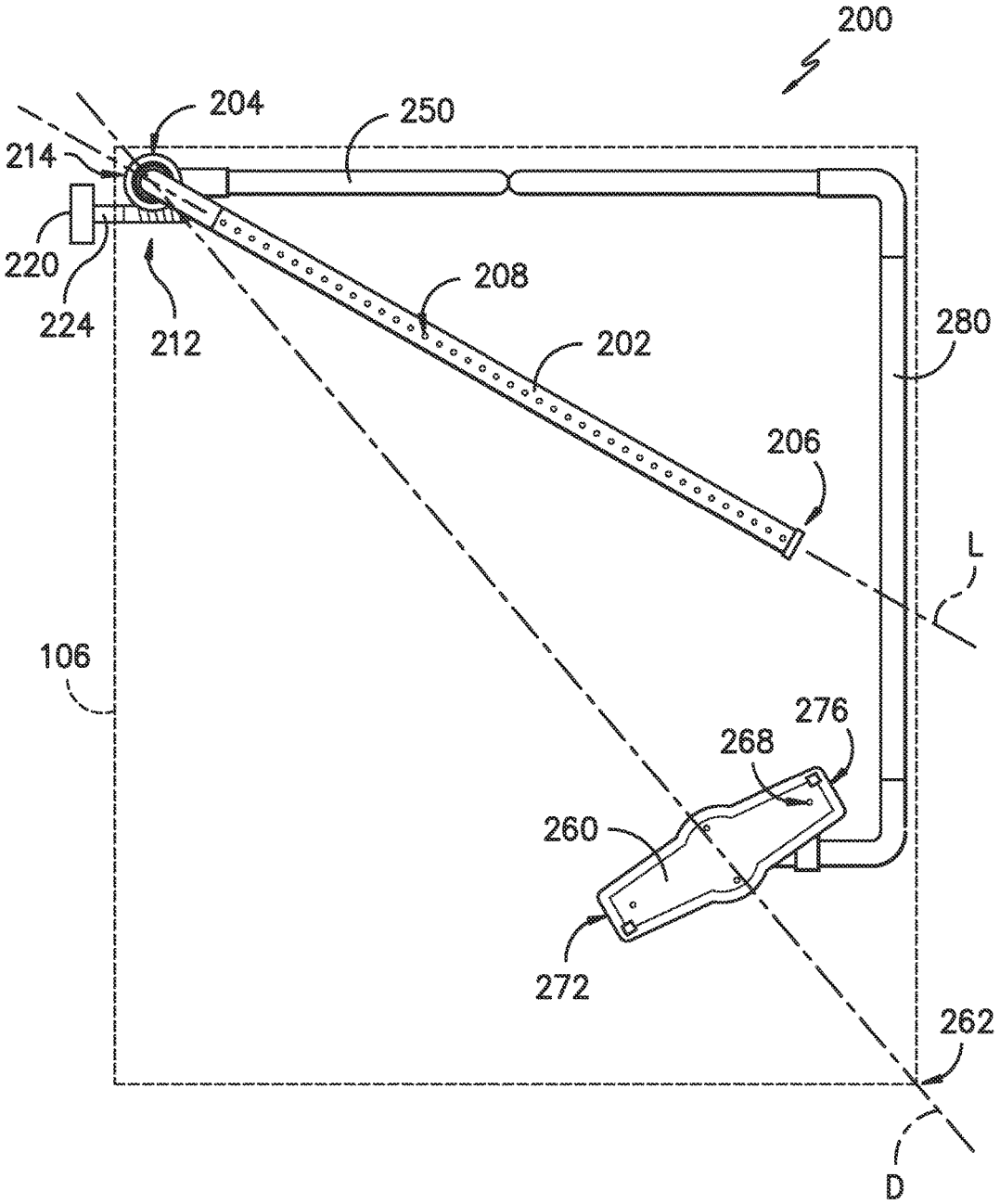
FIG. 5 is a top view of the spray arm system of FIG. 3.
Figure 6:
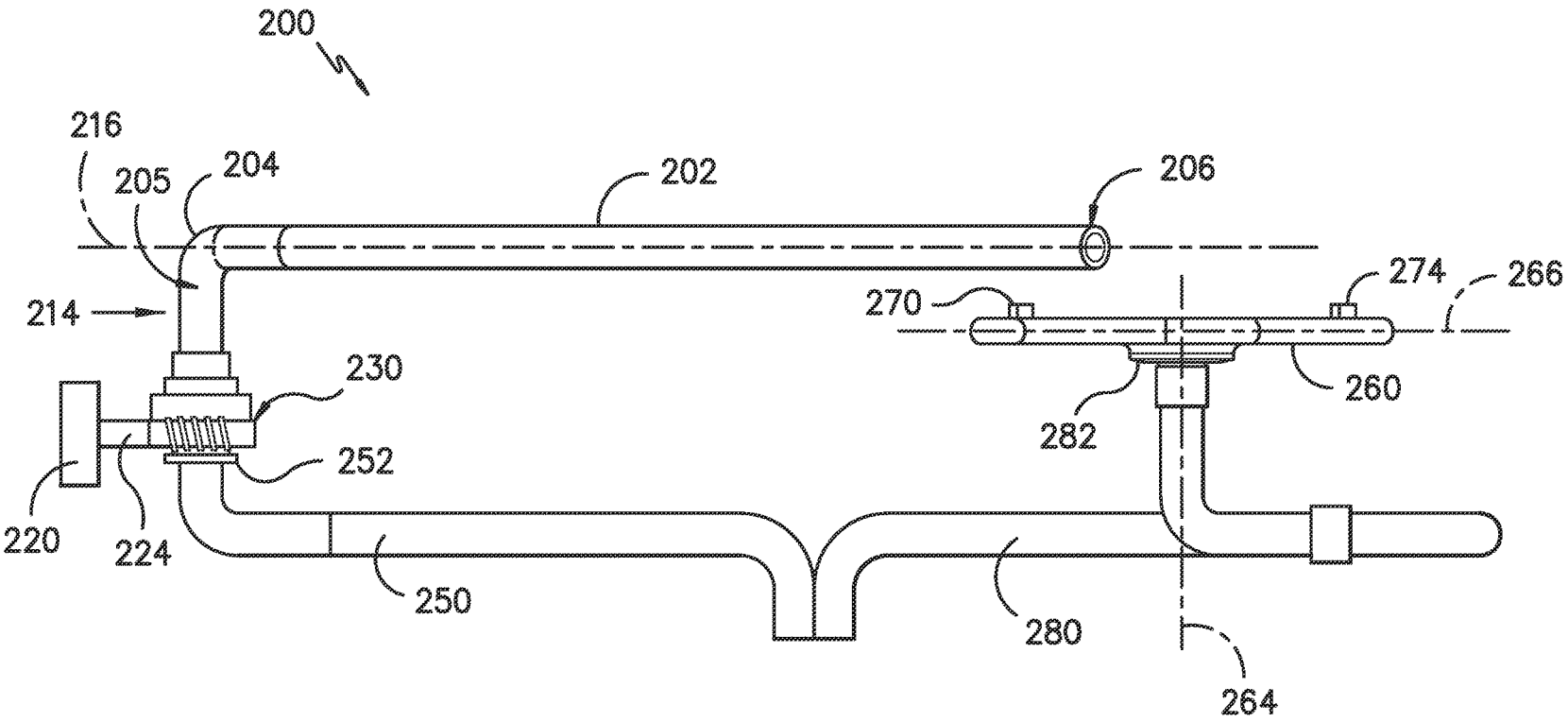
FIG. 6 is a front view of the spray arm system of FIG. 3.
Figure 7:
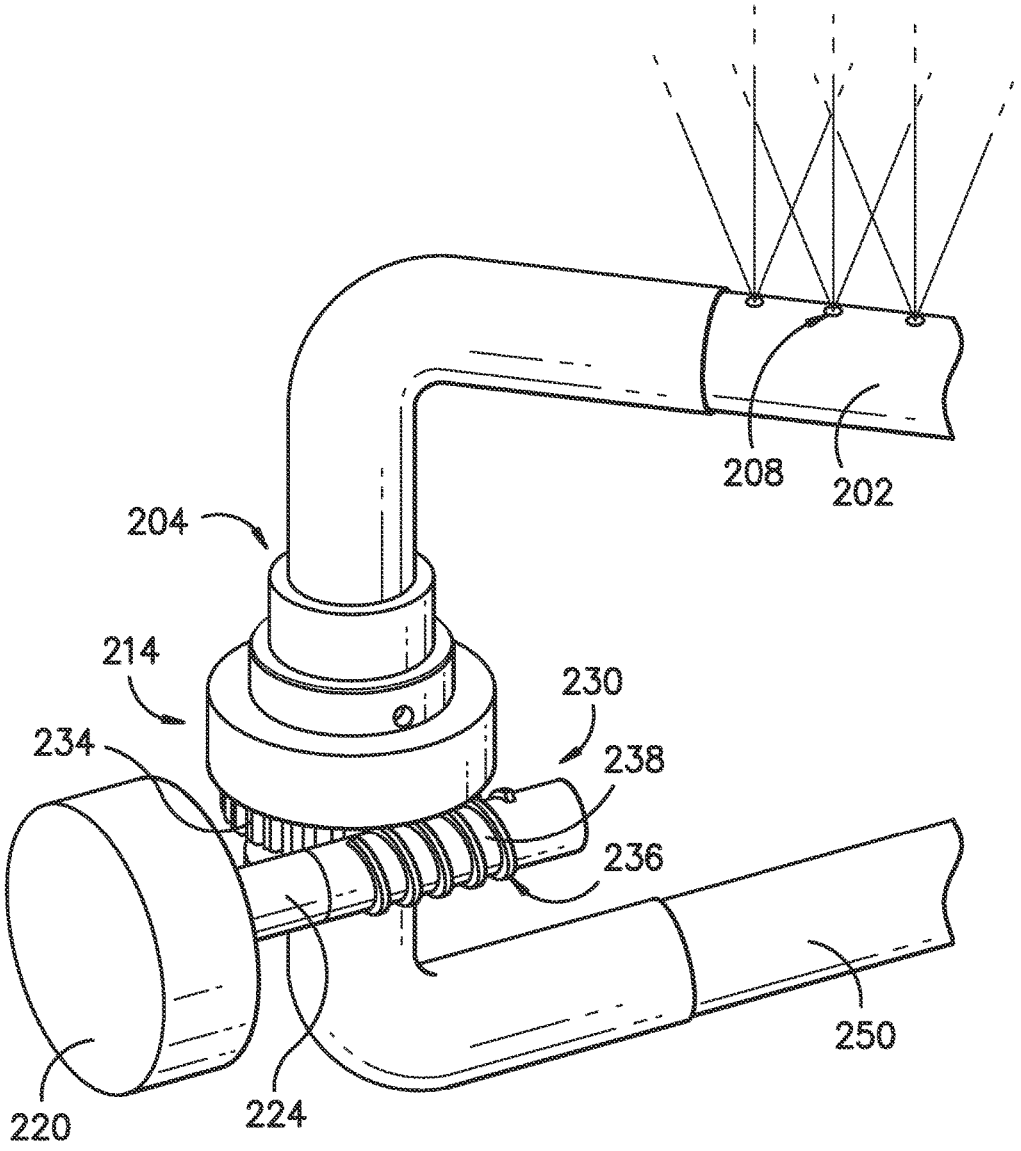
FIG. 7 is a close-up perspective view of a drive motor for pivoting an elongated spray arm of the spray arm system of FIG. 3.
Figure 8:
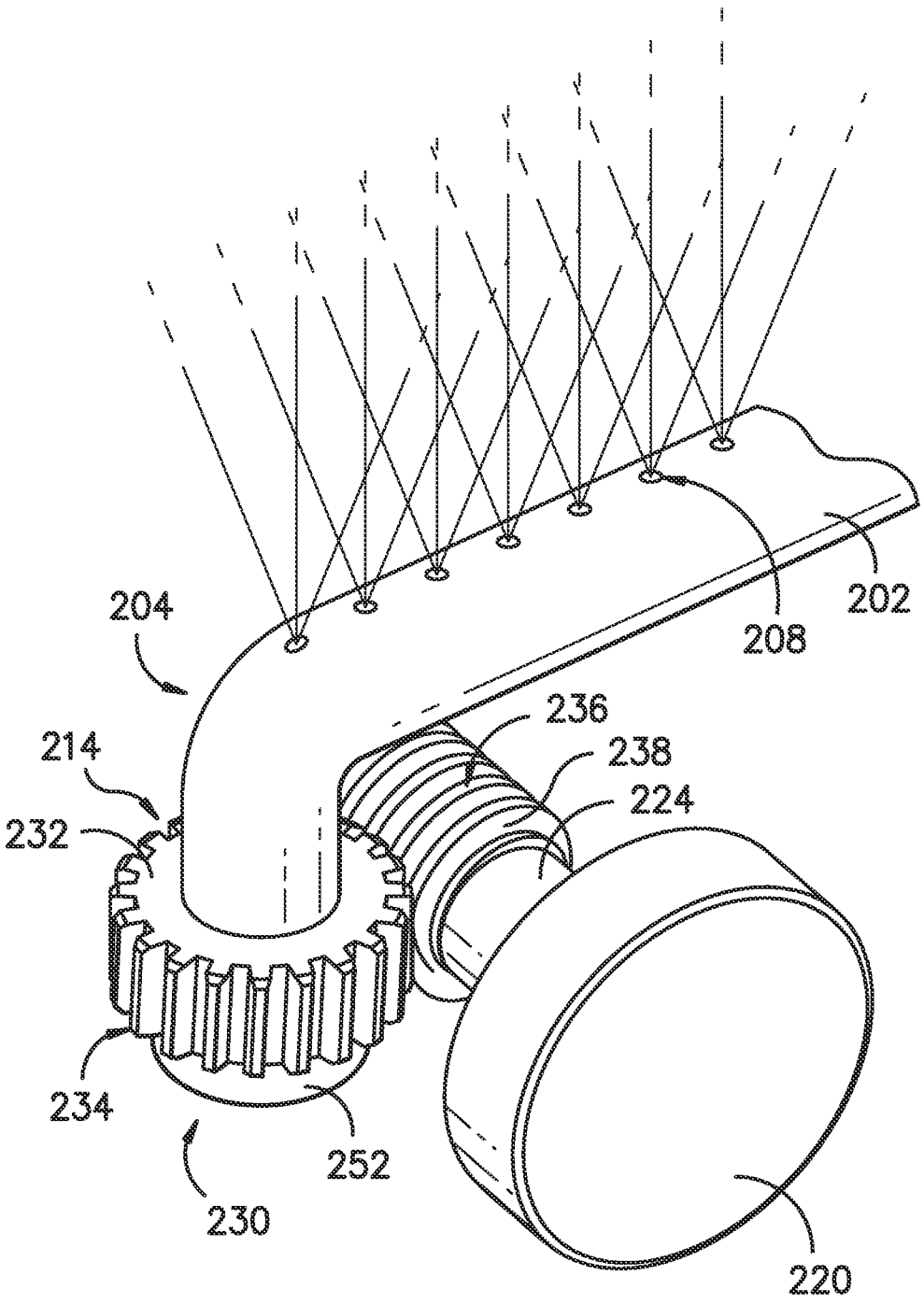
FIG. 8 is a close-up perspective view of the drive motor for pivoting an elongated spray arm of the spray arm system of FIG. 3.
Figure 9:
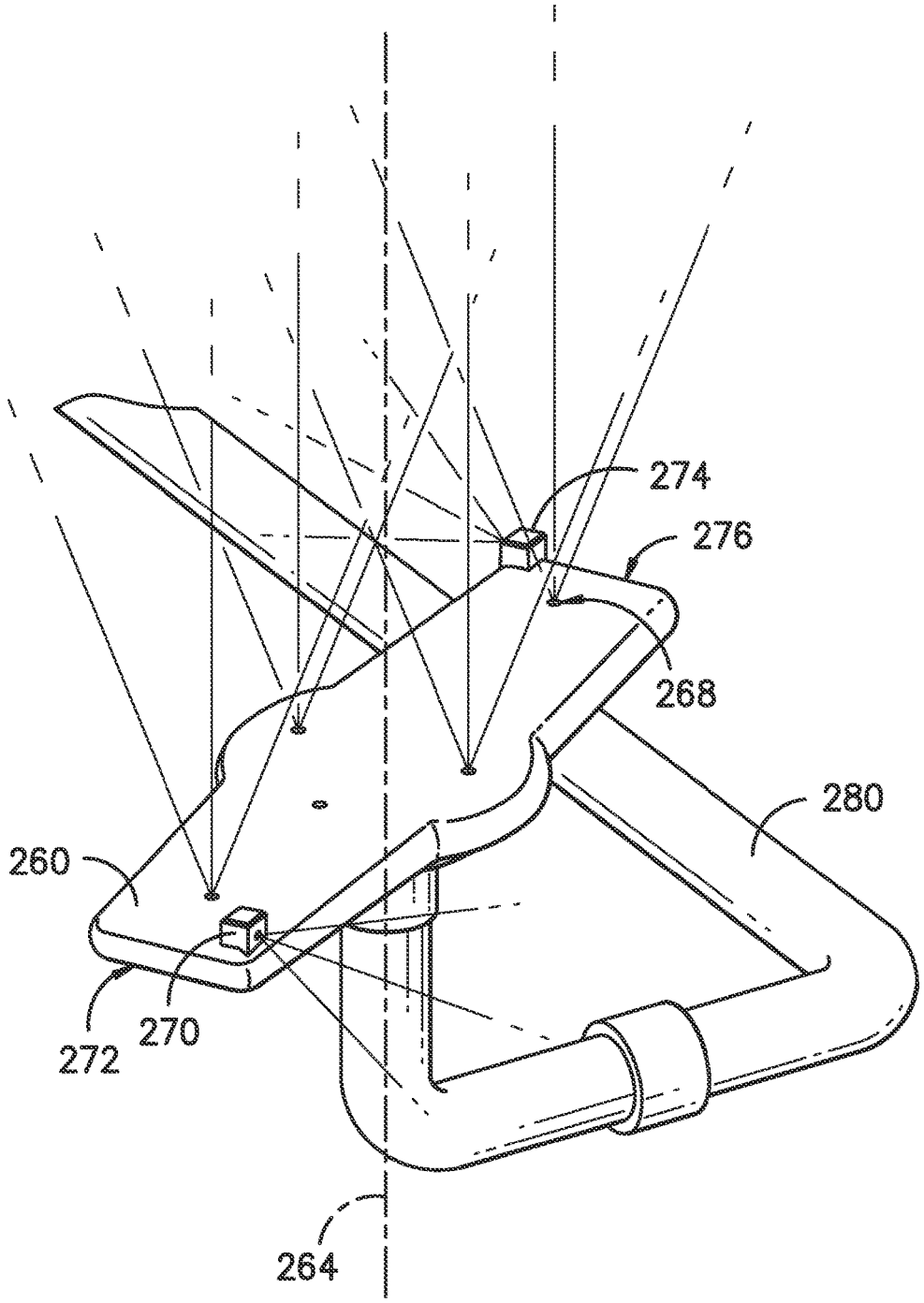
FIG. 9 is a close-up perspective view of an orbital spray arm of the spray arm system of FIG. 3.
Figure 10:
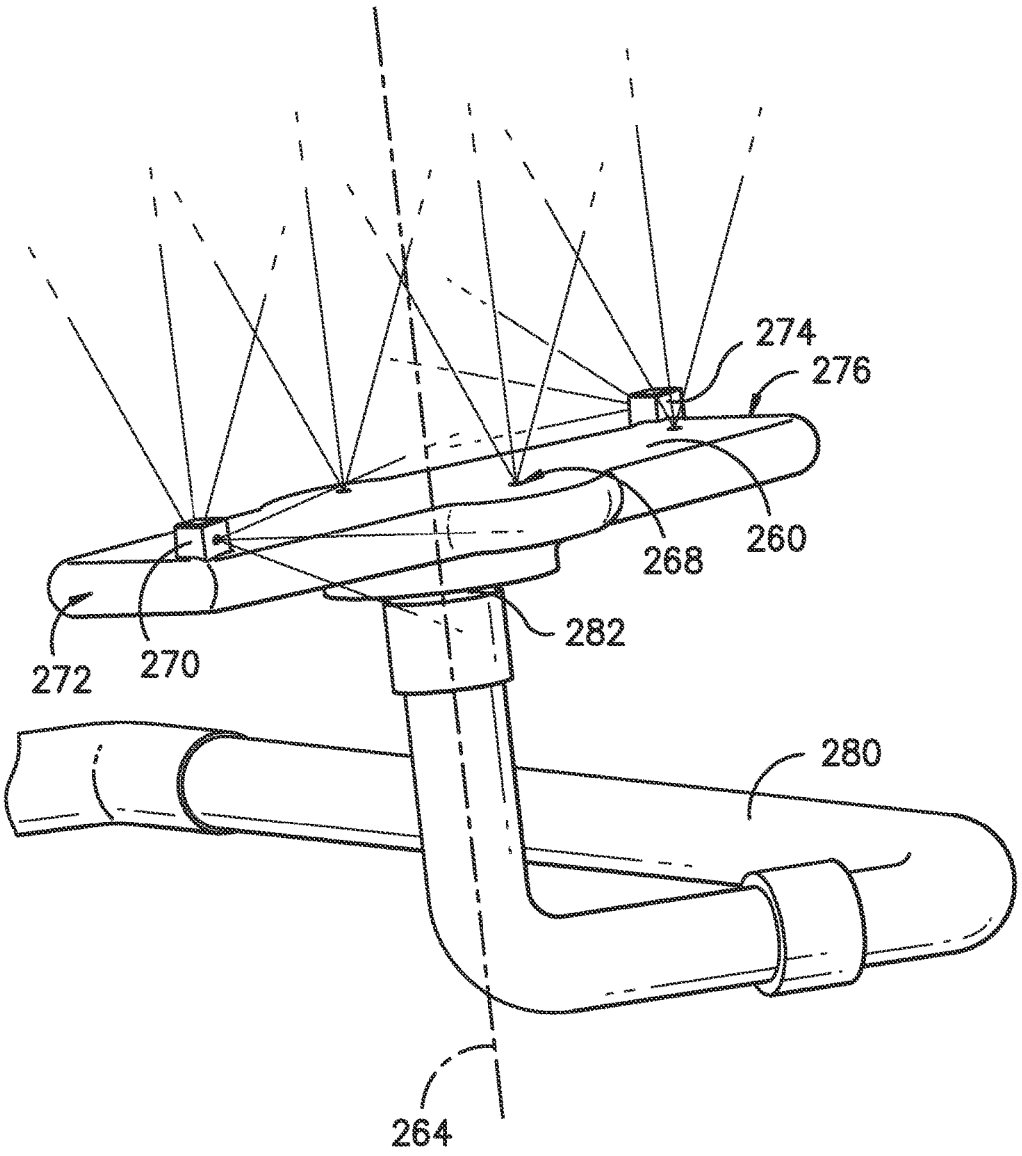
FIG. 10 is a close-up perspective view of the orbital spray arm of the spray arm system of FIG. 3.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown in FIGS. 2 and 3, the tub extends between a top 107 and a bottom 108 along a vertical direction V, between a first side 109 and a second side 110 along a lateral direction L, and between a front side 111 and a rear side 112 along a transverse direction T. Each of the vertical direction V, lateral direction L, and transverse direction T are mutually perpendicular to one another. The tub 104 includes a front opening (not shown) and a door 114 hinged at its bottom 116 for movement between a normally closed vertical position (shown in FIGS. 1 and 2), wherein the wash chamber 106 is sealed shut for washing operation, and a horizontal open position for loading and unloading of articles from the dishwasher 100. Latch 118 is used to lock and unlock door 114 for access to wash chamber 106.

Upper and lower guide rails 120, 122 are mounted on first and second sides 109, 110 of tub 104 and accommodate roller-equipped rack assemblies 126 and 128. Each of the rack assemblies 126, 128 is fabricated into lattice structures including a plurality of elongated members 130 (for clarity of illustration, not all elongated members making up assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 134 and 136, for example, mounted onto racks 126 and 128, respectively. A silverware basket (not shown) may be removably attached to rack assembly 128 for placement of silverware, utensils, and the like, that are otherwise too small to be accommodated by racks 126, 128.

The dishwasher 100 further includes a lower spray arm assembly 140 that will be described in more detail below. The lower spray arm assembly 140 that may be disposed in a lower region 142 of the wash chamber 106 and above a tub sump portion 144 so as to rotate in relatively close proximity to rack assembly 128. A mid-level spray arm assembly 146 is located in an upper region of the wash chamber 106 and may be located in close proximity to upper rack 126. Additionally, an upper spray assembly 148 may be located above the upper rack 126.

The lower and mid-level spray arm assemblies 140, 146 and the upper spray assembly 148 are part of a fluid circulation assembly 150 for circulating water and dishwasher fluid in the tub 104. Fluid circulation assembly 150 may also include a pump 152 positioned in a machinery compartment 154 located below tub sump portion 144 (i.e., bottom 108) of tub 104, as generally recognized in the art. Pump 152 receives fluid from sump 144 and provides a flow to the inlet of a diverter 155 as more fully described below.

Each spray arm assembly 140, 146 includes an arrangement of discharge ports or orifices for directing washing liquid received from diverter 155 onto dishes or other articles located in rack assemblies 126 and 128. The arrangement of the discharge ports, also referred to as jets, apertures, or orifices, in spray arm assemblies 140, 146 may provide a rotational force by virtue of washing fluid flowing through the discharge ports. Alternatively, spray arm assemblies 140, 146, 148 may be motor-driven, as described in detail below. The resultant movement of the spray arm assemblies 140, 146 and the operation of spray assembly 148 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

The dishwasher 100 is further equipped with a controller 156 to regulate operation of the dishwasher 100. The controller 156 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 156 may be positioned in a variety of locations throughout dishwasher 100. In the illustrated embodiment, the controller 156 may be located within a control panel area 158 of door 114 as shown in FIGS. 1 and 2. In such an embodiment, input/output ("I/O") signals may be routed between the control system and various operational components of dishwasher 100 along wiring harnesses that may be routed through the bottom 116 of door 114. Typically, the controller 156 includes a user interface panel/controls 160 through which a user may select various operational features and modes and monitor progress of the dishwasher 100. In one embodiment, the user interface 160 may represent a general purpose I/O ("GPIO") device or functional block. In one embodiment, the user interface 160 may include input components, such as one or more of a variety of electrical, mechanical or electro-mechanical input devices including rotary dials, push buttons, and touch pads. The user interface 160 may include a display component, such as a digital or analog display device designed to provide operational feedback to a user. The user interface 160 may be in communication with the controller 156 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 160, different configurations may be provided for racks 126, 128, different spray arm assemblies 140, 146, 148 may be used, and other differences may be applied as well.

Referring now to FIGS. 3 through 10, various embodiments of a spray arm system 200 are illustrated. Spray arm system 200 may be utilized in dishwasher appliance 100, and advantageously may provide increased wash fluid coverage within dishwasher appliance 100. As shown in FIGS. 2 and 3, spray arm system 200 is used for lower spray arm assembly 140. Alternatively, the spray arm system 200 may be used for mid-level spray arm assembly 146 and/or may be utilized in the place of an upper spray arm assembly 148, or may be utilized in any other suitable position within dishwasher appliance 100. Indeed, according to an exemplary embodiments, spray arm system 200 may be used for all three spray arm assemblies 140, 146, and 148. The spray arm system 200 may generally be in fluid communication with fluid circulation assembly 150 to receive wash fluid therefrom. The wash fluid is then flowed through the spray arm system 200 and exhausted therefrom into the wash chamber 106 during operation of the dishwasher appliance 100, such as during a wash or rinse cycle.

According to an exemplary embodiment, spray arm system 200 may include an elongated spray arm 202. Elongated spray arm 202 may be a rigid or semi-rigid hollow tube that defines a longitudinal axis L (FIG. 5) and extends between a first end 204 and a second end 206. Elongated spray arm 202 may also define a plurality of orifices 208 between first end 204 and second end 206. Wash fluid may be pumped through the hollow interior of elongated spray arm 202 and be propelled out of plurality of orifices 208 toward articles in the wash chamber 106.

Each of the plurality of orifices 208 may direct wash fluid in any particular direction or directions. According to the illustrated embodiment, each of the plurality of orifices 208 sprays within a spray plane that is orthogonal to longitudinal axis L of elongated spray arm 202. More specifically, each orifice 208 sprays plus and minus 30 degrees relative to vertical direction V in that orthogonal spray plane. However, other spray directions and patterns are possible. For example, the plurality of orifices 208 may generate a single spray jet, multiple jets, or a fan-shaped spray pattern. In addition, the plurality of orifices 208 may spray in the same direction, in opposite directions, or may be randomly directed in any manner to improve washing performance. In addition, the plurality of orifices 208 may be adjustable, e.g., by the user or by controller 156. One skilled in the art will appreciate that the angle and pattern of wash fluid spray from each of the plurality of orifices 208 may be adjusted depending on the application to improve cleansing performance and efficiency.

Elongated spray arm 202 may be rotatably mounted at first end 204 at or near a first bottom corner 212 of wash chamber 106. According to the illustrated embodiment, first bottom corner 212 is located on the bottom 108 of wash chamber 106 proximate to rear wall 112 and first side 109 of wash chamber 106. First bottom corner 212 may define a pivot point 214 about which elongated spray arm 202 is configured to swing back and forth within a first horizontal plane 216 (see FIG. 6). In this regard, elongated spray arm 202 may have a 90 degree turn 205 at first end 204 and may be coupled to, for example, a drive motor 220.

Elongated spray arm 202 may be connected to drive motor 220 either directly or through a transmission or gear box. For example, according to the illustrated embodiment, elongated spray arm 202 may be operably coupled to drive motor 220 through a gear box 222. According to the illustrated embodiment, drive motor 220 is disposed outside of wash chamber 106, gear box 222 is disposed inside wash chamber 106, and a drive shaft 224 extends through first side 109 of wash chamber 106 and into gear box 222. However, according to another exemplary embodiment, drive motor 220 and gear box 222 may be located entirely within, or entirely outside, wash chamber 106. A fluid seal, e.g., a grommet, may be used to form a seal around drive shaft 224 where it enters wash chamber 106.

Gear box 222 may house a gear assembly 230 that operatively couples drive motor 220 and elongated spray arm 202. For example, a worm wheel 232 may be attached to first end 204 of elongated spray arm 202. The worm wheel 232 may define gear teeth 234 that engage spiral gear teeth 236 of a worm gear 238. Worm gear 238 may be attached to drive motor 220, e.g., via drive shaft 224. In this manner, as drive motor 220 rotates, worm gear 238 engages worm wheel 232 and causes elongated spray arm 202 to rotate within first horizontal plane 216. Other gear configurations and mechanical transmission means are contemplated and within the scope of the present subject matter.

Drive motor 220, which may be an asynchronous induction motor, such as a louver motor, is configured to rotate elongated spray arm 202 within first horizontal plane 216. To optimize the washing action of elongated spray arm 202, drive motor 220 pivots elongated spray arm 202 about its first end 204 within first horizontal plane 216 in a range of between 0 degrees and 90 degrees about pivot point 214 at first bottom corner 212. In this manner, elongated spray arm 202 reciprocates between a first position parallel to rear wall 112 of wash chamber 106 (i.e., 0 degrees) and a second position parallel to first side 109 of wash chamber 106 (i.e., 90 degrees). When the elongated spray arm 202 reaches 0 degrees or 90 degrees, it will hit the rear wall 112 and first side 109 of wash chamber 106, respectively. Drive motor 220 is configured to sense this obstruction and reverse motor polarity in order to reverse direction and rotate elongated spray arm 202 in the opposite direction. In this manner, drive motor 220 pivots elongated spray arm 202 between the first position and the second position without additional control inputs. However, one skilled in the art will appreciate that other motors and control means are also possible and within the scope of the invention.

Wash fluid may be supplied to elongated spray arm 202 by a first supply pipe 250. First supply pipe 250 may extend from diverter 155 to gear box 222 for providing wash fluid to elongated spray arm 202. More particularly, according to the illustrated embodiment, first supply pipe 250 enters wash chamber 106 in a substantially vertical direction V and is routed directly through the bottom side of gear box 222. In order to ensure fluid does not leak from wash chamber 106, a fluid seal, e.g., a grommet (not shown), may be placed around first supply pipe 250 where it enters wash chamber 106. Elongated spray arm 202 and may be rotatably coupled to first supply pipe 250 by a bearing 252, as is known in the art and may be drivably coupled to drive motor 220, as described above. In this manner, first supply pipe 250 may remain stationary while providing wash fluid to elongated spray arm 202 as it rotates.

Because elongated spray arm 202 extends from first end 204 to second end 206 in a cantilevered manner, and because upward fluid spray tends to impart a downward force on elongated spray arm 202, it may be desirable to provide vertical support to elongated spray arm 202. In the illustrated embodiment, this support is provided by an arcuate support arm 254. Arcuate support arm 254 extends from rear wall 112 to first side 109 of wash chamber 106 in a curved manner in order to provide support to second end 206 of elongated spray arm 202. According to an exemplary embodiment, elongated spray arm 202 may simply slide along arcuate support arm 254, which may be constructed of a rigid material, e.g., metal. Alternatively, elongated support arm 202 may define a notch (not shown) that is configured to slide along the arcuate support arm 254 as the elongated spray arm 202 pivots within first horizontal plane 216. According to yet another exemplary embodiment, a rolling support may be used enable free movement between elongated spray arm 202 and arcuate support arm 254. Other shapes and configurations for support arm 254 may be used as well.

According to an exemplary embodiment, spray arm system 200 may also include an orbital spray arm 260. Orbital spray arm 260 may be rotatably mounted near a second bottom corner 262 of wash chamber 106. Second bottom corner 262 may be located, for example, on the bottom 108 of wash chamber 106 proximate to front 111 and second side 110. More specifically, orbital spray arm 260 defines a central axis 264 that may be located along a diagonal D extending between first bottom corner 212 and second bottom corner 262. In this manner, orbital spray arm 260 may rotate without conflicting with front 111 or second side 110 of wash chamber 106.

As explained above, elongated spray arm 202 may be configured to pivot within first horizontal plane 216. Orbital spray arm 260 may rotate about central axis 264 of orbital spray arm 260 in a second horizontal plane 266. According to the illustrated embodiment, first horizontal plane 216 and second horizontal plane 266 are at different vertical levels—i.e., first horizontal plane 216 is slightly above second horizontal plane 266 in the vertical direction V. In this configuration, elongated spray arm 202 and orbital spray arm 260 may overlap without risk of conflict between the two as they rotate. However, elongated spray arm 202 and orbital spray arm 260 may also be located in the same horizontal plane, in which case the size of the spray arms 202, 260 may need to be adjusted to avoid conflict.

Orbital spray arm 260 may define a plurality of orifices 268 for directing wash fluid onto articles in the wash chamber 106. For example, according to the illustrated embodiment, orbital spray arm 260 includes four orifices 268. However, the number, size, and spray pattern of these orifices may be adjusted in the same manner as described above with respect to elongated spray arm 202. As will be described below, reducing the number and size of the orifices 268 may allow for improved wash performance and reduced water and energy usage.

The plurality of orifices 268 on orbital spray arm 260 may be configured to spray wash fluid in a manner that imparts rotational force to orbital spray arm 260 about central axis 264. According to the illustrated embodiment, the plurality of orifices 268 may emit wash fluid at an orientation that drives rotation of orbital spray arm 260 about central axis 264. According to the illustrated embodiment, orbital spray arm 260 may further include a first spray port 270 that protrudes in a vertical direction V from a first end 272 of orbital spray arm 260 and a second spray port 274 that protrudes from a second end 276 of orbital spray arm 260. First spray port 270 and second spray port 274 may be configured to spray wash fluid in opposite directions to impart rotational force on the orbital spray arm 260 about central axis 264. More specifically, first spray port 270 and second spray port 274 may both emit wash fluid in opposite directions on either side of central axis 264 to impart a clockwise or counterclockwise rotational force to orbital spray arm 260.

Similar to elongated spray arm 202, orbital spray arm 260 receives wash fluid from a second supply pipe 280 that extends from diverter 155, enters wash chamber 106 in a substantially vertical direction V along central axis 264 of orbital spray arm 260, and is rotatably coupled to orbital spray arm 260 by a bearing 282, as is known in the art. In order to ensure fluid does not leak from wash chamber 106, a fluid seal, e.g., a grommet 284, may be placed around second supply pipe 280 where it enters wash chamber 106. In this manner, second supply pipe 280 may remain stationary while providing wash fluid to orbital spray arm 260 as it rotates freely about central axis 264.

Although the exemplary embodiment describes the use of drive motor 220 for pivoting elongated spray arm 202 and the orbital spray arm 260 as being fluid-driven, one skilled in the art will appreciate that each may be either motor-driven or fluid-driven. For example, orbital spray arm 260 may be operably coupled to a drive motor either directly or indirectly (e.g., through a transmission). Similarly, elongated spray arm 202 may spray wash fluid alternately between a first set of orifices that impart clockwise rotational force and a second set of orifices that impart counterclockwise rotational force to pivot between 0 degrees and 90 degrees. Indeed, any means for imparting rotational force on elongated spray arm 202 and orbital spray arm 260 may be used and remain within the scope of the present subject matter.

Notably, diverter 155 may be configured for selectively distributing wash fluid to one or both of the elongated spray arm 202 and the orbital spray arm 260. In this manner, diverter 155 may have two outputs and may supply wash fluid to the first supply pipe 250 and second supply pipe 280 either independently or simultaneously. This provides versatility of operation of dishwasher appliance 100. More specifically, by providing wash fluid to only one of elongated spray arm 202 and orbital spray arm 260, spray arm system 200 may be configured to provide a zone wash feature. For example, when only orbital spray arm 260 receives the full flow of wash fluid, this may be beneficial to create a scouring zone where high liquid flow rate is focused on only a single section of dishwasher appliance 100. Heavily soiled pots and pans may be placed over orbital spray arm 260 for improved cleaning performance and decreased energy and/or water usage.

According to an exemplary embodiment, diverter 155 may receive wash fluid from a variable speed pump. In this manner, the speed of the pump may be adjusted to provide wash fluid to the spray arm system 200 at different pressures. The variable speed pump may thereby be configured to adjust a spray height of wash fluid from the elongated spray arm 202 and the orbital spray arm 260. In addition, because orbital spray arm 260 is small in size and has fewer orifices compared to conventional spray arms, the variable speed pump may be used to operate orbital spray arm 260 at a lower pressure and flow rate, substantially reducing water and energy usage.

As described above, elongated spray arm 202 is driven by drive motor 220 via gear box 222, and gear box 222 may be placed inside or outside wash chamber 106. In addition, orbital spray arm 260 is fluid-driven, and requires only a bearing 282 between it and second supply pipe 280 in order to operate. This construction lends itself to a low-profile spray arm system 200 that may have a lower overall height and may maximize the usable space in wash chamber 106. More specifically, by moving gear box 222 outside of wash chamber 106, each of elongated spray arm 202 and orbital spray arm 260 may be placed immediately proximate to bottom 108 of wash chamber 106. Indeed, only a small segment of pipe is needed to space spray arms 202, 260 away from bottom 108 of wash chamber 106 so that they may rotate freely. Thus, for example, lower rack 128 may be moved downward to maximize space for placing articles within wash chamber 106.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spray arm system for cleaning articles in a wash chamber defined by a wash tub of a dishwasher appliance, the wash tub having a bottom defining a first bottom corner and an opposing, second bottom corner, the spray arm system comprising:

an elongated spray arm having a first end and a second end, the elongated spray arm defining a plurality of orifices between the first end and the second end for directing wash fluid onto articles in the wash chamber, the elongated spray arm being rotatably mounted at the first end to the first bottom corner so as to define a pivot point about which the elongated spray arm is configured to swing back and forth within a first horizontal plane to cover a first coverage area within the first horizontal plane;

a drive motor operably coupled with the elongated spray arm, the drive motor being positioned outside of the wash tub proximate the first bottom corner; and a rotating spray arm defining a plurality of orifices for directing wash fluid onto articles in the wash chamber, the rotating spray arm being positioned near the second bottom corner and being rotatable about a central axis of the rotating spray arm within the first horizontal plane to cover a second coverage area within the first horizontal plane that does not overlap with the first coverage area.

2. The spray arm system of claim 1, wherein the elongated spray arm is configured to pivot within the first horizontal plane in a range of between 0 degrees and 90 degrees about the pivot point at the first bottom corner.

3. The spray arm system of claim 1, wherein the rotating spray arm is located along a diagonal extending between the first bottom corner and the second bottom corner.

4. The spray arm system of claim 1, wherein the rotating spray arm rotates within a second horizontal plane at different vertical level from the first horizontal plane.

5. The spray arm system of claim 1, further comprising a worm wheel attached to the elongated spray arm at the first end, the worm wheel defining gear teeth; and a worm gear attached to the drive motor and having spiral gear teeth engaging the gear teeth of the worm wheel.

6. The spray arm system of claim 1, further comprising an arcuate support arm for supporting the second end of the elongated spray arm as the elongated spray arm pivots.

7. The spray arm system of claim 6, wherein the elongated spray arm defines a notch that is configured to slide along the arcuate support arm as the elongated spray, arm pivots.

8. The spray arm system of claim 1, wherein the plurality of orifices on the rotating spray arm is configured to spray wash fluid in a manner that imparts rotational force to the rotating spray arm about the central axis.

9. The spray arm system of claim 1, wherein the rotating spray arm comprises a first spray port that protrudes from a first end of the rotating spray arm and a second spray port that protrudes from a second end of the rotating spray arm, the first spray port and the second spray port being configured to spray wash fluid in opposite directions along a horizontal plane to impart rotational force on the rotating spray arm about the central axis.

10. The spray arm system of claim 1, further comprising a diverter for selectively distributing wash fluid to one or both of the elongated spray arm and the rotating spray arm.

11. The spray arm system of claim 1, wherein a variable speed pump provides the wash fluid to the spray arm system.

12. A dishwasher appliance, comprising:

a wash tub that defines a wash chamber, the wash chamber defining lateral, transverse, and vertical directions;

a rack assembly slidably positioned within the wash chamber of the tub and configured for receipt of articles for washing;

a spray arm system comprising:

a first spray arm assembly comprising a drive motor positioned outside of the wash tub proximate a first bottom corner of the wash chamber, a gear box disposed at the first bottom corner of the wash chamber and operatively coupling the drive motor to an elongated spray arm, the elongated spray arm having a first end at the first bottom corner and a second end and being configured to pivot about the first end between 0 degrees and 90 degrees in a first horizontal plane to cover a first coverage area within the first horizontal plane; and a second spray arm assembly comprising a rotating spray arm being positioned near a second bottom corner and being rotatable about a central axis of the rotating spray arm, the rotating spray arm further defining at least two spray jets configured to spray in opposite directions along a horizontal plane to impart rotational force on the rotating spray arm about the central axis within the first horizontal plane to cover a second coverage area within the first horizontal plane that does not overlap with the first coverage area; and a diverter for selectively distributing wash fluid from a recirculating pump to the spray arm system.

13. The dishwasher appliance of claim 12, further comprising a worm wheel attached to the elongated spray arm at the first end, the worm wheel defining gear teeth; and a worm gear attached to the drive motor and having spiral gear teeth engaging the gear teeth of the worm wheel.

14. The dishwasher appliance of claim 12, further comprising an arcuate support arm for supporting the second end of the elongated spray arm as the elongated spray arm pivots.

15. The dishwasher appliance of claim 14, wherein the elongated spray arm defines a notch that is configured to slide along the arcuate support arm as the elongated spray arm pivots.

16. The dishwasher appliance of claim 12, wherein the diverter is configured for selectively distributing wash fluid to one or both of the first spray atm assembly, and the second spray arm assembly.

17. The dishwasher appliance of claim 12, wherein the rotating spray arm comprises a first spray port that protrudes from a first end of the rotating spray arm and a second spray port that protrudes from a second end of the rotating spray arm, the first spray port and the second spray port being configured to spray wash fluid in opposite directions to impart rotational force on the rotating spray arm about the central axis.

18. The dishwasher appliance of claim 12, wherein the recirculating pump is a variable speed pump.

19. The dishwasher appliance of claim 18, wherein the variable speed pump is configured to adjust a spray height of wash fluid from the first spray arm assembly and the second spray arm assembly.

* * * * *